US009254649B2

(12) United States Patent
Moriya et al.

(10) Patent No.: US 9,254,649 B2
(45) Date of Patent: Feb. 9, 2016

(54) LIQUID EJECTION HEAD, METHOD FOR MANUFACTURING LIQUID EJECTION HEAD, AND LIQUID EJECTING APPARATUS

(71) Applicant: CANON KABUSHIKI KAISHA, Tokyo (JP)

(72) Inventors: Takatsugu Moriya, Tokyo (JP); Shuzo Iwanaga, Kawasaki (JP); Kazuhiro Yamada, Yokohama (JP); Takuto Moriguchi, Kamakura (JP); Zentaro Tamenaga, Sagamihara (JP); Akira Yamamoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/707,959

(22) Filed: May 8, 2015

(65) Prior Publication Data

US 2015/0321476 A1 Nov. 12, 2015

(30) Foreign Application Priority Data

May 12, 2014 (JP) ..... 2014-098476
Mar. 20, 2015 (JP) ..... 2015-057352

(51) Int. Cl.
*B41J 2/14* (2006.01)
*B41J 2/16* (2006.01)

(52) U.S. Cl.
CPC ..... *B41J 2/14072* (2013.01); *B41J 2/1623* (2013.01)

(58) Field of Classification Search
CPC ..... B41J 2202/21
See application file for complete search history.

(56) References Cited

U.S. PATENT DOCUMENTS 5,016,023 A * 5/1991 Chan ..... B41J 2/1601 29/890.1
6,099,109 A * 8/2000 Komuro ..... B41J 2/14024 347/50
8,550,599 B2 * 10/2013 Miyazaki ..... B41J 2/135 347/50

FOREIGN PATENT DOCUMENTS

JP 2010-521343 A 6/2010

* cited by examiner

*Primary Examiner* — Juanita D Jackson
(74) *Attorney, Agent, or Firm* — Canon USA Inc. IP Division

(57) ABSTRACT

A liquid ejection head including: a support member, a plurality of printing element boards arranged linearly on the support member, an electric wiring member fixed to the support member, and configured to transmit an electrical signal necessary to eject a liquid to the plurality of printing element boards, a plurality of conductive members arranged in an arranging direction of the plurality of printing element boards, and configured to electrically connect the plurality of printing element boards to the electric wiring member, and a thermosetting sealing member extending in the arranging direction and covering the conductive members, connecting points of the printing element boards with the conductive members, and connecting points of the electric wiring member with the conductive members, wherein the sealing member is divided at, at least one place in the arranging direction.

20 Claims, 4 Drawing Sheets

LIQUID EJECTION HEAD, METHOD FOR MANUFACTURING LIQUID EJECTION HEAD, AND LIQUID EJECTING APPARATUS

BACKGROUND OF THE INVENTION

1. Field of the Invention

The present invention generally relates to a liquid ejection head that ejects a liquid, a method for manufacturing a liquid ejection head, and a liquid ejecting apparatus provided with a liquid ejection head. More particularly, the present invention relates to a configuration of a sealing member in a liquid ejection head in which a plurality of printing element boards are arranged linearly.

2. Description of the Related Art

A printing element board provided with a large number of printing elements, such as heating resistance elements and piezoelectric elements, is used in a liquid ejection head, such as an inkjet recording head. The greater the number of the printing elements provided in the printing element board and the longer the recording width of the printing element board, the higher the recording speed becomes. To record at a higher speed, a linear head in which a plurality of printing element boards are arranged linearly in a length corresponding to a width direction of a recording medium is receiving attention. For example, the linear head has a plurality of recording modules each having a printing element board and a support member, and a plurality of recording modules are arranged linearly in the width direction of the recording medium. PCT Japanese Translation Patent Publication No. 2010-521343 discloses a linear head in which a plurality of printing element boards are arranged linearly on a common support member. Since a common support member is used, the size of the linear head may be reduced. A plurality of printing element boards are arranged linearly in the direction parallel to the long sides. An electric wiring member for transmitting an electrical signal necessary for the ejection of a liquid to the printing element board is disposed so as to face one long side of each printing element board.

Generally, in the liquid ejection head, the printing element board and the electric wiring member are connected electrically by a conductive member, such as a wire and a lead. The conductive member is protected by a sealing member to prevent disconnection due to a short circuit caused by an ejected liquid and due to contact with the recording medium. In the liquid ejection head disclosed in PCT Japanese Translation Patent Publication No. 2010-521343, the conductive member is disposed along the long side of the printing element board. Therefore, a linear sealing member is provided continuously along the long sides of the plurality of printing element boards.

If a thermosetting sealing member is used, the liquid ejection head is heated during the manufacture to cure the sealing member. The support member, the printing element boards, and the sealing member expand when heated, are mutually fixed or restrained in a thermally expanded state. In the liquid ejection head, the coefficient of linear expansion of the sealing member is generally larger than the coefficient of linear expansion of the support member or the coefficient of linear expansion of the printing element board. Therefore, when the liquid ejection head is made to restore to a normal temperature after the sealing member is cured, the sealing member applies compressive force to the support member and the printing element boards. For this reason, the support member and the printing element boards may be bent and positions of the ejection ports on the printing element board may, therefore, be shifted, which may decrease recording quality. Further, flow paths, for example, of the printing element boards may be deformed and damaged.

SUMMARY OF THE INVENTION

According to the present invention, a liquid ejection head includes, a support member, a plurality of printing element boards arranged linearly on the support member, an electric wiring member fixed to the support member, and configured to transmit an electrical signal necessary to eject a liquid to the plurality of printing element boards, a plurality of conductive members arranged in an arranging direction of the plurality of printing element boards, and configured to electrically connect the plurality of printing element boards to the electric wiring member, and a thermosetting sealing member extending in the arranging direction and covering the conductive members, connecting points of the printing element boards with the conductive members, and connecting point of the electric wiring member with the conductive members, wherein the sealing member is divided at at least one place in the arranging direction.

According to the present invention, a liquid ejection head with reduced influence of, for example, misalignment of printing element boards by heat applied during a manufacturing process is provided.

Further features of the present invention will become apparent from the following description of exemplary embodiments with reference to the attached drawings.

DESCRIPTION OF THE EMBODIMENTS

A liquid ejection head of the present invention is described with reference to a general inkjet recording head. The liquid ejection head of the present invention is applicable to every liquid ejecting apparatus, such as an inkjet recording apparatus. The term "recording" herein includes not only forming significant information, such as characters and figures, but includes forming non-significant information and forming information not visually perceived by a human being (i.e., not visually actualized). The term "recording" herein includes not only forming, for example, an image and a pattern by ejecting a liquid on a recording medium, but includes processing the recording medium by ejecting a liquid on the recording medium. The term "recording medium" herein includes not only paper used in a general recording apparatus, but includes a medium that may receive liquids, such as cloth, plastic film, a metal plate, glass, ceramic, wood, and leather. The term "liquid" herein is not limited to ink, and should be broadly interpreted as in the definition of the term "recording." The term "liquid" herein includes a liquid used for the formation of, for example, an image and a pattern, used for the processing of a recording medium, or processing of ink by being applied to the recording medium.

First Embodiment

Figure 1A:
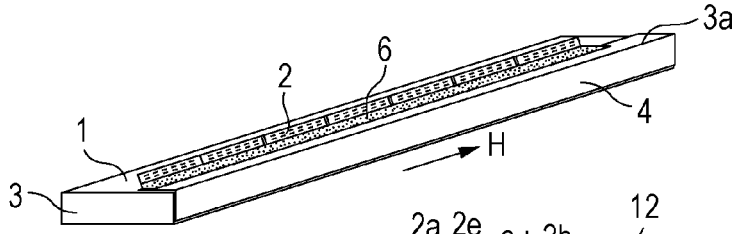
FIGS. 1A to 1F are diagrams illustrating a liquid ejection head according to a first embodiment.
Figure 1B:
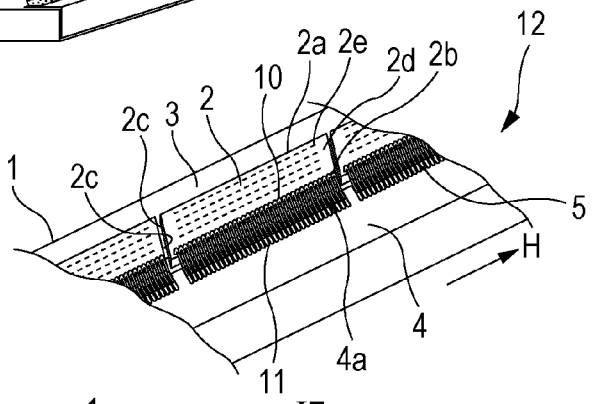

With reference to FIGS. 1A to 1F, a liquid ejection head according to a first embodiment of the present invention is described. FIG. 1A is a perspective view schematically illustrating the liquid ejection head according to the first embodiment. FIG. 1B is an enlarged perspective view of FIG. 1A, excluding a sealing member.

A liquid ejection head 1 has a support member (a first support member) 3 and a plurality of printing element boards 2 arranged linearly on the support member 3. The support member 3 desirably has high rigidity to be less flexible, and has sufficient corrosion resistance against an ejected liquid, such as ink. The support member 3 is made suitably of, for example, alumina, silicon carbide, and graphite.

The printing element boards 2 are the same in shape, which is a substantial parallelogram. Short sides 2*c* extend obliquely to long sides 2*a* (that is, the short sides 2*c* and the long sides 2*a* do not cross orthogonally). Since the printing element boards 2 are substantial parallelogram in shape, a plurality of printing element boards are arranged not in a staggered pattern but substantially linearly, and ejection ports of adjoining printing element boards are connectable. Therefore, a small-sized full linear head is obtained. In the present invention, however, the printing element boards 2 may be substantially rectangular in shape. A plurality of ejection ports 2*e* through which a liquid is ejected are formed in an ejection port surface 2*d* of each printing element board 2. A plurality of printing element boards 2 are arranged adjoining to one another in a direction in which a long side 2*a* extends, and form one elongated liquid ejecting portion as a whole. In this specification, the direction in which the printing element boards 2 are arranged is referred to as an arranging direction H, which substantially coincides with the direction of the long sides 2*a* of each printing element board 2. In the present embodiment, seven printing element boards 2 are arranged in the arranging direction H. Each printing element board 2 has a plurality of heating resistance elements (not illustrated) that generate thermal energy for heating and ejecting the liquid. Each heating resistance element is connected to a terminal 2*b* of the printing element board 2 via a wire (not illustrated) extending inside the printing element board 2. The terminal 2*b* is disposed in the arranging direction H along one long side 2*a* (that faces an electric wiring member 4 described later) of the printing element board 2.

An electric wiring member 4 is fixed to the support member 3 with an adhesive. The electric wiring member 4 is formed of a flexible printed circuit board (FPC), and transmits electrical signals necessary for the ejection of the liquid to a plurality of printing element boards 2. A plurality of wires (not illustrated) extend inside the electric wiring member 4, and the wires form a lead electrode 4*a* at a position facing the printing element board 2. The lead electrode 4*a* of the electric wiring member 4 is electrically connected to the terminal 2*b* of the printing element board 2 by an electrically conductive member 5, such as a wire and a lead. Therefore, electrical signals necessary for the ejection of the liquid is transmitted to the plurality of printing element boards 2. The conductive member 5 is provided by, for example, wire bonding. The electric wiring member 4 is folded at a corner 3*a* of the support member 3, and is connected to a control circuit (not illustrated) of a liquid ejecting apparatus main body. In the present embodiment, one electric wiring member 4 is provided as a common electric wiring member of a plurality of printing element boards 2.

Figure 1C:
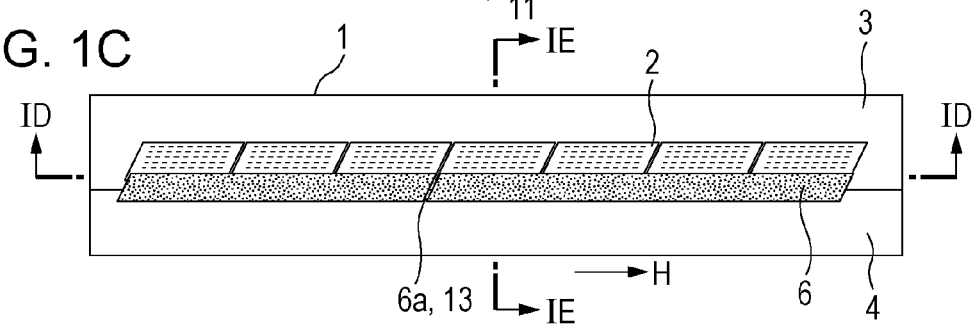
Figure 1D:
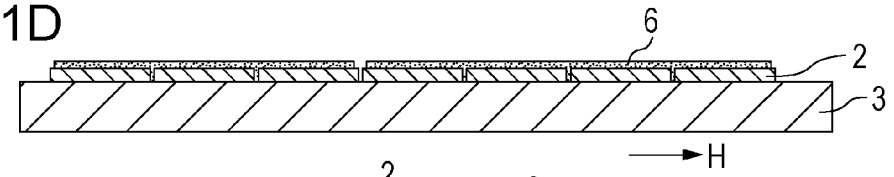
Figure 1E:
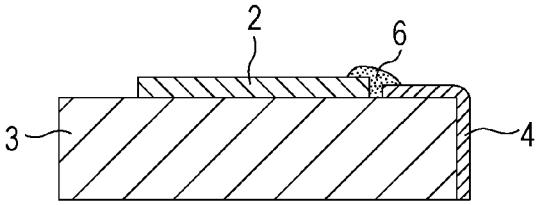

The sealing member is described with reference to FIGS. 1C to 1E. FIG. 1C is a front view of the liquid ejection head 1 illustrated in FIG. 1A seen from the direction perpendicularly crossing the ejection port surface 2*d*, FIG. 1D is a cross-sectional view along line ID-ID of FIG. 1C, and FIG. 1E is a cross-sectional view along line IE-IE of FIG. 1C. The conductive member 5, a connecting point 10 of the printing element board 2 that electrically connects to one end side of the conductive member 5, and a connecting point 11 of the electric wiring member 4 that electrically connects to the other end side of the conductive member 5 are covered with a thermosetting sealing member 6. That is, the sealing member 6 not only covers the conductive member 5, but is formed partially on surfaces of the printing element board 2 and the electric wiring member 4. The sealing member 6 protects the conductive member 5, and reduces disconnection due to a short circuit caused by the ejected liquid and due to contact with a recording medium. The sealing member 6 is made of thermosetting resin. The sealing member 6 is applied at a normal temperature, and then is heated to a curing temperature and is cured. A plurality of conductive members 5 are arranged in the arranging direction H of the printing element boards 2, and the sealing member 6 extends so as to cover the conductive members 5 in the arranging direction H along the long sides 2*a* of the printing element boards 2 that face the electric wiring member 4. As illustrated in FIG. 1E, the sealing member 6 restrains the printing element boards 2 and the electric wiring member 4, and the electric wiring member 4 is fixed to the support member 3. Therefore, the printing element boards 2 and the support member 3 are mutually restrained by the sealing member 6.

In the present embodiment, adjoining printing element boards 2 are arranged close to one another and substantially linearly, but the sealing member 6 is divided into two via a gap in the arranging direction H. In the present embodiment, a distance between the adjoining printing element boards 2 is about 30 μm. As in this case in which a plurality of printing element boards 2 are disposed close to each other within 50 μm and are arranged linearly, the sealing member 6 is desirably divided to reduce an influence of stress.

As illustrated in the diagrams, two independent sealing regions are provided in the arranging direction H. Thus, force that the support member 3 receives from the sealing member 6 is reduced. The reason is as follows. Force F that a first member applies to a second member due to expansion and contraction of these mutually restrained two members is generally expressed by Expression (1):

$$F=(\Delta L_1-\Delta L_2)\cdot E_1 \quad (1).$$

Here, ΔL denotes an amount of thermal expansion and contraction of each member, E denotes the Young's modulus of each member, a subscript 1 denotes the first member that applies force to the second member due to thermal expansion and contraction, and a subscript 2 denotes the second member that receives the force from the first member due to thermal expansion and contraction. The amount of thermal expansion and contraction ΔL is expressed by Expression (2):

$$\Delta L=\alpha\cdot L\cdot\Delta T \quad (2).$$

Here, α denotes a coefficient of linear expansion, L denotes a length of the member, and ΔT denotes a temperature change. If Expressions (1) and (2) are combined, the force F that the first member applies to the second member due to thermal expansion and contraction is expressed by Expression (3):

$$F=(\alpha_1-\alpha_2)\cdot L\cdot\Delta T\cdot E_1 \quad (3).$$

Expression (3) shows that the force that the support member 3 receives is proportional to the length L of the sealing member 6. Therefore, if the sealing member 6 extends continuously without being divided, L in Expression (3) becomes large and the support member 3 receives large force due to thermal expansion and contraction of the sealing member 6.

In particular, the sealing member 6 has a larger coefficient of linear expansion than those of the support member 3 and the printing element board 2. At a high temperature, the sealing member 6 is cured in a thermally expanded state and, at a normal temperature, internal compression stress is produced with which the sealing member 6 tries to restore an original form thereof. Therefore, a portion of the support member 3 restrained by the sealing member 6 is compressed by the sealing member 6. Usually, since the sealing member 6 is not on a major axis of the support member 3, the support member 3 thermally deforms so that the major axis is bent (i.e., bent in a width direction) and, therefore, an arrangement axis that joins central axes of the printing element boards 2 is also bent. When the printing element boards 2 are deformed, positions of the ejection ports 2*e* of the printing element boards 2 are shifted from desired positions, and print positions on the recording medium are also shifted from desired positions. Even if the sealing member 6 is on the central axis of the support member 3, when the printing element boards 2 are compressed along the arrangement axis, print positions on the recording medium are shifted from desired positions. In the present embodiment, as illustrated in FIGS. 1C and 1D, since the sealing member 6 is divided into two sections, the length L of Expression (3) becomes substantially the half. Therefore, the force F caused by thermal expansion and contraction is reduced to substantially the half, and deformation of the printing element boards 2 may be prevented.

The liquid ejection head 1 is manufactured in the following manner. First, the printing element boards 2 and the electric wiring member 4 are fixed to the support member 3 with, for example, an adhesive. Next, the terminal 2*b* of the printing element board 2 and the lead electrode 4*a* of the electric wiring member 4 are connected by the conductive member 5 by, for example, wire bonding. An assembly (i.e., a unit) 12 (see FIG. 1B) of the support member 3, the conductive member 5, the printing element boards 2, the electric wiring member 4, and the conductive member 5 is thus manufactured. Next, the sealing member 6 is applied to the conductive member 5, the connecting point 10 of the printing element boards 2 with the conductive member 5, and the connecting point 11 of the electric wiring member 4 with the conductive member 5. A dividing portion 13 is provided in the middle of the sealing member 6, and the sealing member 6 is divided as described above. It is only necessary that the sealing member 6 is applied to be divided at at least one place in the arranging direction H. The dividing portion 13 is desirably provided at a position at which the printing element boards 2 adjoin to each other. The sealing member 6 is then heated and cured.

Figure 1F:
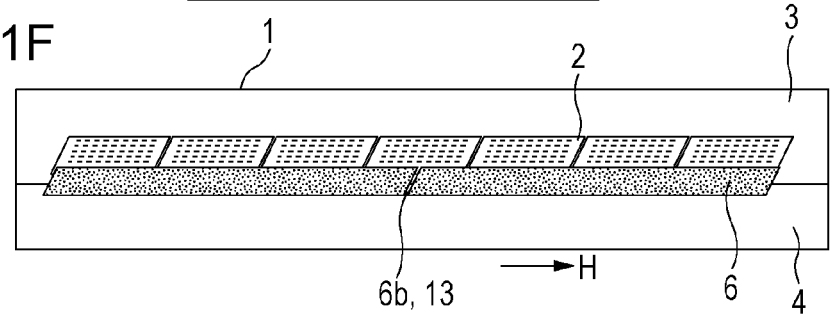

As illustrated in FIGS. 1C and 1D, the sealing member 6 is divided at a dividing portion 13 near a boundary of the third printing element board 2 from the left and the fourth printing element board 2 from the right. That is, the sealing member 6 is divided at a position 6*a* facing a position between two mutually-facing end sides 2*c* (which correspond to the above-described short sides 2*c*) of the adjoining printing element boards 2. Therefore, all the conductive members 5 may be covered with the sealing member 6 irrespective of the arrangement of the terminals 2*b* of the printing element boards 2 and the lead electrodes 4*a* of the electric wiring member 4. Alternatively, as illustrated in FIG. 1F, the sealing member 6 may be divided at a position 6*b* facing a middle portion of each printing element board 2 in the arranging direction H. In this case, the dividing portion 13 is desirably determined so that all the conductive members 5 are covered with the sealing member 6. In the present invention, it is important that the length of the sealing member 6 is short and, therefore, the dividing position of the sealing member 6 is not limited. It is only necessary that the sealing member 6 is divided at at least one place in the arranging direction H.

Figure 2A:
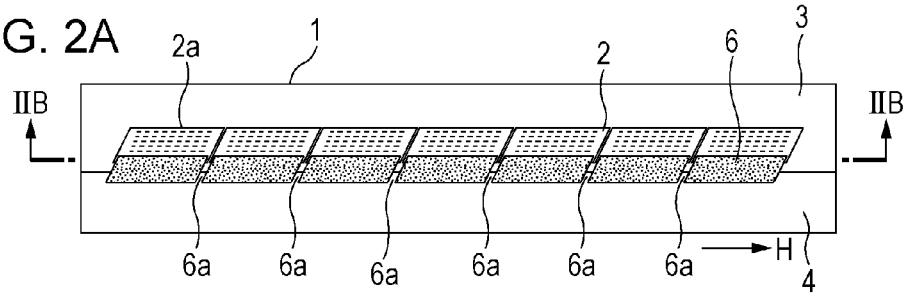
FIGS. 2A to 2E are diagrams illustrating a modification of the liquid ejection head according to the first embodiment.
Figure 2B:
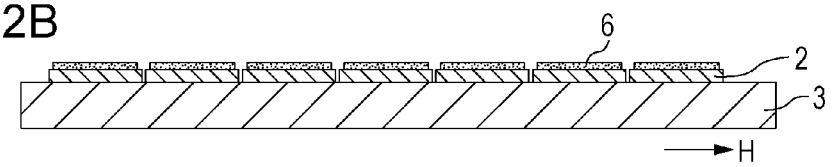
Figure 2C:
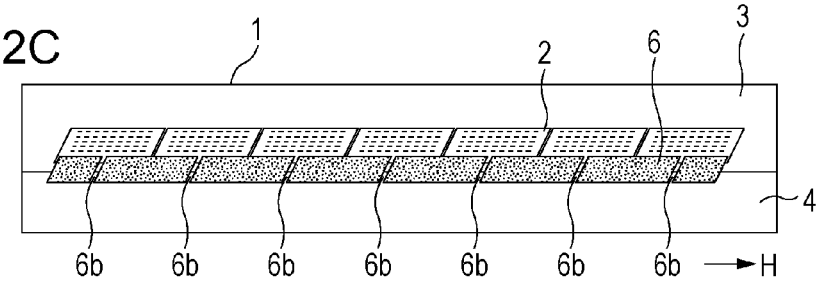

FIGS. 2A to 2E illustrate a modification of the present embodiment. The sealing member 6 may be divided at two or more places to shorten the length of the sealing member 6 and to further reduce the amount of thermal expansion and contraction. FIG. 2A is a front view of the liquid ejection head 1 seen from the direction perpendicularly crossing the ejection port surface 2*d*, similar to that of FIG. 1C. FIG. 2B is a cross-sectional view along line IIB-IIB of FIG. 2A. In the present embodiment, the sealing member 6 is divided at positions 6*a* each facing the position at which the printing element boards 2 adjoin to one another. That is, the sealing member 6 independent for each printing element board 2 is formed, and the length of each divided portion of the sealing member 6 in the arranging direction H is substantially the same as the length of the long side 2*a* of the printing element board 2. The length of the sealing member 6 is even shorter than that of the embodiment illustrated in FIGS. 1A to 1F. Therefore, the amount of thermal expansion and contraction and curvature in the width direction of the liquid ejection head 1 are reduced. FIG. 2C illustrates another modification. The sealing member 6 is divided at positions 6*b* each facing the middle portion of each printing element board 2 in the arranging direction H. Although not illustrated, the sealing member 6 may be divided at both the position 6*a* facing the position between two mutually-facing end sides 2*c* of the adjoining printing element boards 2, and the position 6*b* facing the middle portion of the printing element board 2 in the arranging direction H.

Figure 2D:
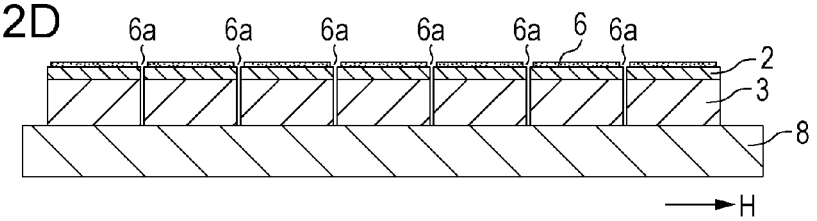

It is not necessary that the support member 3 is formed integrally with the liquid ejection head 1 in the longitudinal direction. FIG. 2D illustrates such a modification. FIG. 2D is a cross-sectional view of the liquid ejection head 1 along the same position as that of FIG. 2B. The sealing member 6 and the support member 3 are divided at the positions 6*a* each facing the position at which the printing element boards 2 adjoin to one another. Each of the printing element boards 2 and the divided section of the support member 3 constitute one unit. Each of the divided section of the support member 3 is fixed to a common base member (i.e., a second support member) 8 extending in the longitudinal direction of the liquid ejection head 1. The dividing positions and the number of divisions of the support member 3 are not limited. The support member 3 may be divided, for example, so that one support member 3 corresponds to two or more printing element boards 2. It is only necessary that the support member 3 is divided at at least some dividing positions of the sealing members 6 in the arranging direction H.

Figure 2E:
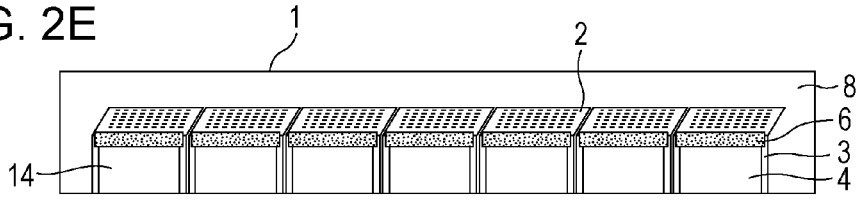

The electric wiring member 4 may also be divided in the same manner as the support member 3. Since the electric wiring member 4 has a greater coefficient of linear expansion than those of the support member 3 and the printing element board 2, the electric wiring member 4 may affect the support member 3 in the same manner as the sealing member 6. From this viewpoint, the electric wiring member 4 is desirably divided at at least one place in the arranging direction H in at least a fixing portion 14 to the support member 3. For example, as illustrated in FIG. 2E, the support member 3 and the electric wiring member 4 may be divided to correspond to each printing element board 2. By dividing the support member 3, the electric wiring member 4, and the sealing member 6 at the position 6*a* facing the position between two mutually-facing end sides 2*c* of the printing element boards 2, a module in which the printing element board 2, the support member 3, the electric wiring member 4, and the sealing member 6 are handled as a unit may be manufactured. Since the electric wiring member 4 is adhered to the support member 3, it is possible to manufacture a module in which the electric wiring member 4 is provided in advance for each printing element board 2. By fixing each module to the common base member 8, in addition to the effect of reducing the stress described above, it is possible to manufacture the liquid ejection head 1 with high yield. A method for manufacturing the form of FIG. 2E is described. A unit member in which the support member 3, the printing element board 2, and the electric wiring member 4 are unified is prepared. In this unit state, the printing element board 2 and the electric wiring member 4 are electrically connected by, for example, the conductive member 5. After a plurality of these units are prepared, a sealing agent is applied to an electric connection portion of each unit, and the sealing member 6 is formed. After the sealing member 6 is formed to each unit, each unit is fixed to a base member 8, which is a support member. When this manufacturing process is employed, even in a liquid ejection head in which adjoining printing element boards 2 are disposed linearly close to each other (e.g., equal to or less than 50 μm), integration (i.e., contact) of adjoining sealing members 6 may be prevented and, therefore, a plurality of independent sealing members 6 may be formed.

Second Embodiment

Figure 3A:
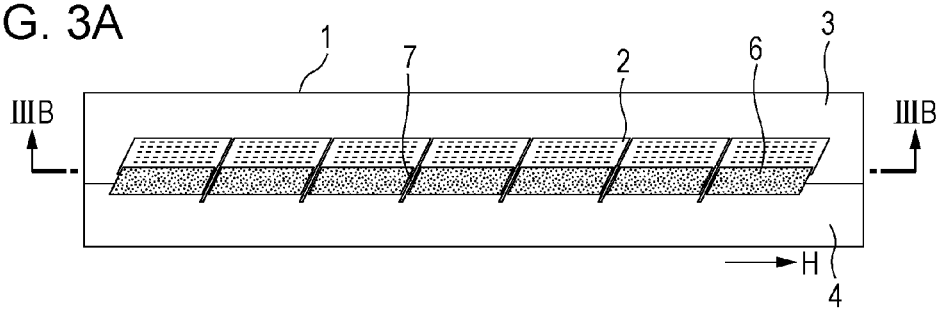
FIGS. 3A to 3E are diagrams illustrating a liquid ejection head according to a second embodiment.
Figure 3B:
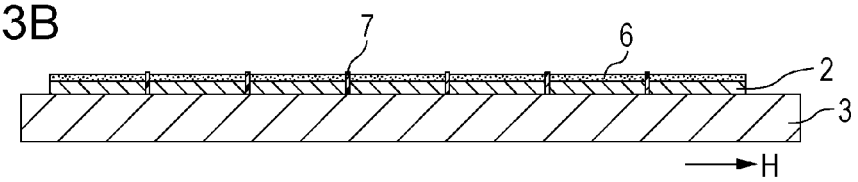
Figure 3C:
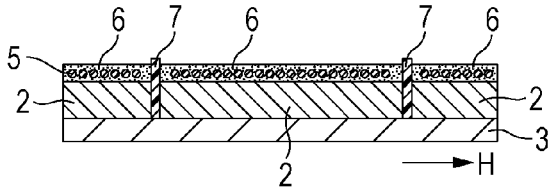

With reference to FIGS. 3A to 3E, a liquid ejection head according to a second embodiment of the present invention is described. FIG. 3A is a front view of the liquid ejection head 1 seen from the direction perpendicularly crossing the ejection port surface, FIG. 3B is a cross-sectional view along line IIIB-IIIB of FIG. 3A. FIG. 3C is a partially enlarged view of FIG. 3B.

In a liquid ejection head in which a plurality of printing element boards are arranged linearly, a gap is formed between adjoining printing element boards. The greater the gap becomes, the lower printing quality becomes. Therefore, it is required to reduce the gap to about tens of micrometers to perform high quality printing. If, as illustrated in FIG. 1B, the terminal 2*b* of the printing element board 2 is disposed to the end portions of the printing element board 2 in the longitudinal direction, the sealing member 6 needs to cover the end portions of the printing element board 2. Therefore, if the sealing member 6 is divided in the manner as in the first embodiment, the sealing member 6 needs to be applied at intervals of about tens of micrometers. However, it is sometimes difficult to apply the sealing member 6 at intervals of about tens of micrometers with the limitations of accuracy in application.

In the second embodiment, the intermediate member 7 independent of the support member 3 is disposed at the position at which the sealing member 6 is divided. After the intermediate member 7 is disposed, the sealing member 6 is applied so that the sealing member 6 is divided. That is, the liquid ejection head 1 according to the second embodiment has the intermediate member 7 that extends from the position between two mutually-facing end sides 2*c* of the adjoining printing element boards 2 to the sealing member 6, and divides the sealing member 6. In particular, before the sealing member 6 is applied, the intermediate member 7 that extends from the position between the two mutually-facing end sides 2*c* of the adjoining printing element boards 2 to the position exceeding a connecting point 11 of the electric wiring member 4 with the conductive member 5. The intermediate member 7 is provided to a height exceeding the printing element boards 2, and also exceeding an upper surface of the sealing member 6 when seen from the support member 3. The sealing member 6 is applied to be divided in the arranging direction H by the intermediate member 7. Therefore, the sealing member 6 is easily divided at narrower intervals.

The intermediate member 7 is formed by a film-shaped flexible member made of, for example, polypropylene (PP). The thickness of the intermediate member 7 may be arbitrarily determined to be smaller than the intervals of the adjoining printing element boards 2. In the present embodiment, since the intervals of the adjoining printing element boards 2 is about 30 μm, the thickness of the intermediate member 7 is equal to or less than 25 μm. The intermediate member 7 may be in contact with both the mutually-facing end sides 2*c* of the printing element boards 2, may be in contact with only one of the end sides 2*c*, or not in contact with any of these end sides 2*c*.

Here, a configuration in which the sealing member 6 is divided into two as illustrated in FIG. 1C, and the intermediate member 7 is provided between them is considered. Here, if the length of the left sealing member 6 is l1, the length of the intermediate member 7 is l2, and the length of the right sealing member 6 is l3, force F2 caused by thermal expansion and contraction that the sealing member 6 and the intermediate member 7 apply to the support member 3 is expressed by Expression (4):

$$F_2=(\alpha_{sealing\ member}-\alpha_{support\ member})\cdot(l_1+l_3)\cdot\Delta T\cdot E_{sealing\ member}+(\alpha_{intermediate\ member}-\alpha_{support\ member})-l2\cdot\Delta T\cdot E_{intermediate\ member} \quad (4).$$

Since it is only necessary that force F2 due to thermal expansion and contraction is smaller than force due to thermal expansion and contraction of the sealing members 6 continuously arranged in the longitudinal direction, it is necessary that the following relationship is satisfied:

$$F2<(\alpha_{sealing\ member}-\alpha_{support\ member})\cdot L\cdot\Delta T\cdot E_{sealing\ member} \quad (5).$$

Here, $$L=l_1+l_2+l_3 \quad (6)$$

and, if Expressions (4), (5) and (6) are combined, $$(\alpha_{intermediate\ member}-\alpha_{support\ member})\cdot E_{intermediate\ member}<(\alpha_{sealing\ member}-\alpha_{support\ member})\cdot E_{sealing\ member} \quad (7).$$

As described above, regarding the intermediate member 7, the product of a difference between the coefficient of linear expansion of the intermediate member 7 and the coefficient of linear expansion of the support member 3 and the Young's modulus of the intermediate member 7 is smaller than the product of a difference between the coefficient of linear expansion of the sealing member 6 and the coefficient of linear expansion of the support member 3 and the Young's modulus of the sealing member 6.

Figure 3D:
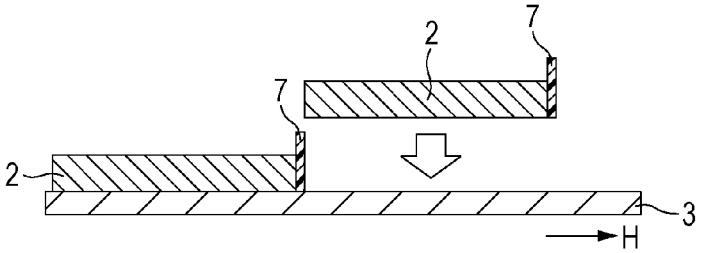

If the intermediate member 7 is an about tens of micrometers-thick film, it is sometimes difficult to dispose the intermediate member 7 in a gap between adjoining printing element boards 2 during the manufacture of the liquid ejection head 1. Therefore, as illustrated in FIG. 3D, it is desirable to adhere the intermediate member 7 to an end side 2*c* (i.e., a side surface) of a first printing element board 2 before the printing element boards 2 are disposed on the support member 3 and to dispose, on the support member 3, the printing element board 2 in which the intermediate member 7 is fixed to the end side 2*c* (i.e., the side surface). Then, a second printing element board 2 is disposed on the support member 3 so as to be adjoin to the first printing element board 2 via the intermediate member 7, and then the sealing member 6 is applied.

According to this manufacturing method, the intermediate member 7 may be easily provided between the printing element boards 2.

Figure 3E:
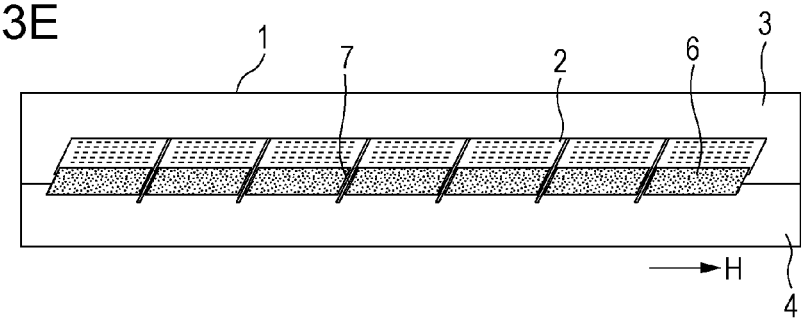

The intermediate member 7 may be integrated with the support member 3 as long as the relationship of above Expression (7) is satisfied. To prevent ink from gathering in the gap between the printing element boards 2, as illustrated in FIG. 3E, the intermediate member 7 may be provided to cover the entire length of the mutually-facing end sides 2*c* of the printing element boards 2.

Third Embodiment

Figure 4A:
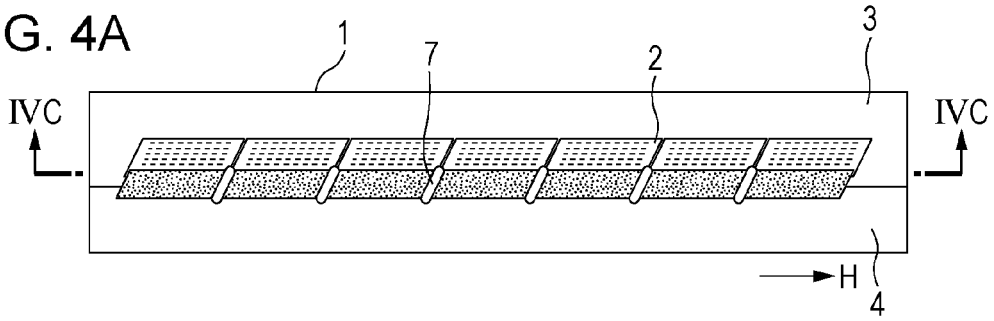
FIGS. 4A to 4E are diagrams illustrating a liquid ejection head according to a third embodiment.
Figure 4B:
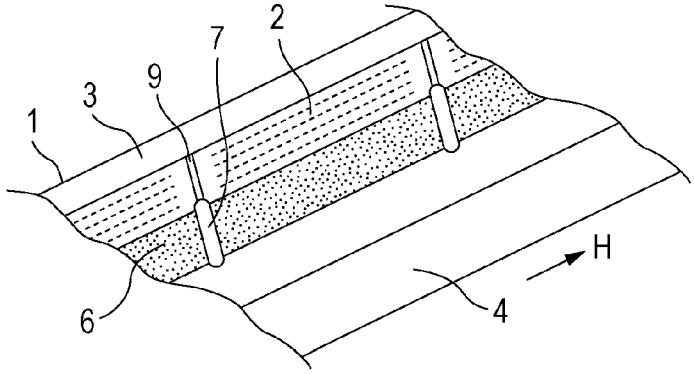
Figure 4C:
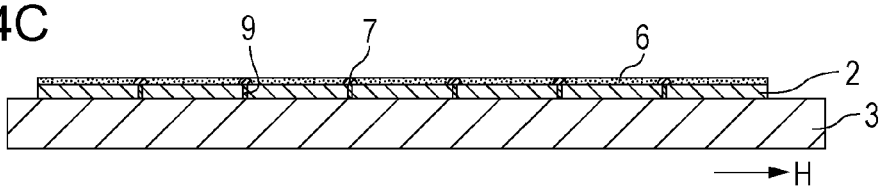
Figure 4D:
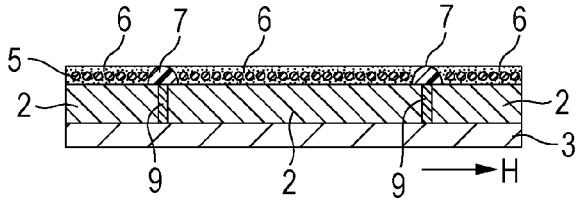

With reference to FIGS. 4A to 4E, a liquid ejection head 1 according to a third embodiment of the present invention is described. FIG. 4A is a front view of the liquid ejection head 1 seen from the direction perpendicularly crossing the ejection port surface, FIG. 4B is a partially enlarged view of FIG. 4A, FIG. 4C is a cross-sectional view along line IVC-IVC of FIG. 4A, and FIG. 4D is a partially enlarged view of FIG. 4C.

If the interval between the printing element boards 2 is about tens of micrometers, and especially if the interval is so narrow that a flexible member, such as a film, is not disposed therein, it is sometimes difficult to dispose the intermediate member 7 in the gap between the printing element boards 2. Therefore, in the present embodiment, as the intermediate member 7, a member independent of the support member 3 and made of the same material as that of the sealing member, or an adhesive independent of the support member 3 is used. The sealing member or the adhesive may be those commercially available. The sealing agent and the adhesive are flowable and are provided, by a suitable means, such as application and dropping, at the position of the space between the printing element boards 2 and the electric wiring member 4 at which the support member 3 is to be provided. The intermediate member 7 may be applied to a part of the ejection port surface of the printing element boards 2, but is applied so as not to touch the ejection ports 2*e* of the printing element boards 2. The sealing agent and the adhesive are cured to become the intermediate member 7. In the same manner as in the second embodiment, the intermediate member 7 is provided to a height exceeding the printing element boards 2, and also exceeding an upper surface of the sealing member 6 when seen from the support member 3. Then the sealing member 6 is applied and is divided by the intermediate member 7. The sealing agent and the adhesive are cured even more during the manufacturing process of the head, solidify when the liquid ejection head 1 is completed, and maintain their shapes. In the same manner as in the second embodiment, regarding the intermediate member 7, the product of a difference between the coefficient of linear expansion of the intermediate member 7 and the coefficient of linear expansion of the support member 3 and the Young's modulus of the intermediate member 7 is smaller than the product of a difference between the coefficient of linear expansion of the sealing member 6 and the coefficient of linear expansion of the support member 3 and the Young's modulus of the sealing member 6.

If the intermediate member 7 is formed by a flowable sealing agent or a flowable adhesive, it is sometimes difficult to form the sealing agent and the adhesive in stable shapes. Therefore, before disposing the intermediate member 7, it is desirable to fill the space with a filling member 9 and then dispose the sealing agent and the adhesive (i.e., the intermediate member 7) above the filling member 9. In this manner, the intermediate member 7 for separating the sealing member 6 may be formed reliably. If the sealing agent and the adhesive have high viscosity, it is not necessary to provide the filling member 9. In that case, the space below the intermediate member 7 may be a cavity. Alternatively, the intermediate member 7 may function also as the filling member 9.

Figure 4E:
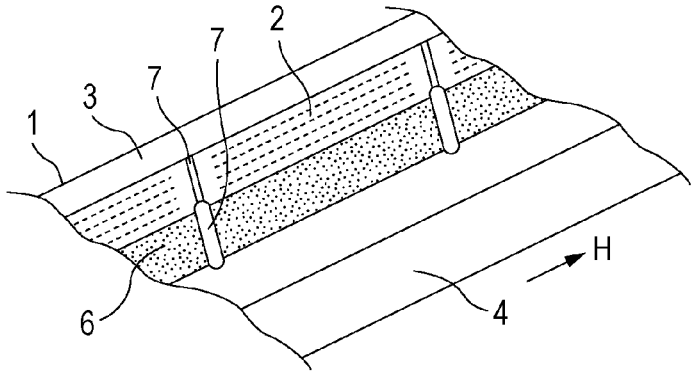

The filling member 9 is desirably disposed at least in an area in which the intermediate member 7 is disposed, and more desirably disposed to cover the entire width of the space between the printing element boards 2 and the electric wiring member 4. Further, to prevent ink from gathering in the space between the printing element boards 2, as illustrated in FIG. 4B, the filling member 9 may be provided in at least a part of the gap between the adjoining printing element boards 2, and desirably, provided to cover the entire length of the gap. Alternatively, to prevent ink from gathering in the space between the printing element boards 2, as illustrated in FIG. 4E, the filling member 9 may be provided to cover the entire length of the gap between the adjoining printing element boards 2, and the intermediate member 7 may be disposed thereabove.

In each embodiment described above, the electric connection portion is provided only in one of the long sides 2*a* of each printing element board 2. By providing the electric connection portion only in one of the sides of each printing element board 2, as illustrated in FIG. 2E, the size of the electric wiring member 4 may be reduced, and the liquid ejection head may be reduced in size and cost. Further, a sealing process of the electric connection portion is easily performed. This configuration, however, is not restrictive: the present invention is applicable also to, for example, a configuration in which the electric connection portion is provided in each of the two long sides 2*a* of each printing element board 2, and the sealing member is provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-098476, filed May 12, 2014 and 2015-057352, filed Mar. 20, 2015 which are hereby incorporated by reference herein in their entirety.

What is claimed is:

1. A liquid ejection head, comprising:

a support member;

a plurality of printing element boards arranged linearly on the support member;

an electric wiring member fixed to the support member, and configured to transmit an electrical signal necessary to eject a liquid to the plurality of printing element boards;

a plurality of conductive members arranged in an arranging direction of the plurality of printing element boards, and configured to electrically connect the plurality of printing element boards to the electric wiring member; and a thermosetting sealing member extending in the arranging direction and covering the conductive members, connecting points of the printing element boards with the conductive members, and connecting point of the electric wiring member with the conductive members, wherein the sealing member is divided at at least one place in the arranging direction.

2. The liquid ejection head according to claim 1, wherein the sealing member is divided at a position facing a position between two mutually-facing end sides of the adjoining the printing element boards.

3. The liquid ejection head according to claim 2, further comprising an intermediate member extending from a position between the two mutually-facing end sides of the adjoining printing element boards to the sealing member, and dividing the sealing member, wherein a product of a difference between a coefficient of linear expansion of the intermediate member and a coefficient of linear expansion of the support member and the Young's modulus of the intermediate member is smaller than a product of a difference between a coefficient of linear expansion of the sealing member and a coefficient of linear expansion of the support member and the Young's modulus of the sealing member.

4. The liquid ejection head according to claim 3, wherein the intermediate member is provided to cover the entire length of the two end sides.

5. The liquid ejection head according to claim 3, wherein the intermediate member is fixed to one of the end sides.

6. The liquid ejection head according to claim 3, wherein the intermediate member is in contact with both of the end sides.

7. The liquid ejection head according to claim 1, wherein the electric wiring member is divided at at least one place of a fixing portion to the support member in the arranging direction.

8. The liquid ejection head according to claim 7, wherein the support member and the electric wiring member are each divided at a position facing a position between two mutually-facing end sides of the adjoining printing element boards.

9. The liquid ejection head according to claim 7, wherein the intermediate member is a flexible member independent of the support member.

10. The liquid ejection head according to claim 7, wherein the intermediate member is independent of the support member, is made of the same material as that of the sealing member, or is an adhesive independent of the support member.

11. The liquid ejection head according to claim 7, wherein the intermediate member is integrated with the support member.

12. The liquid ejection head according to claim 1, wherein the sealing member is divided at a position facing the intermediate portion of the printing element board in the arranging direction.

13. The liquid ejection head according to claim 1, wherein the support member is divided at a dividing position of at least a part of the sealing member in the arranging direction.

14. A liquid ejecting apparatus provided with the liquid ejection head according to claim 1.

15. A method for manufacturing a liquid ejection head, comprising:

applying, to an assembly, a thermosetting sealing member extending in the arranging direction and covering the conductive members, connecting points of the printing element boards with the conductive members, and connecting point of the electric wiring member with the conductive members, the assembly including a support member, a plurality of printing element boards arranged linearly on the support member, an electric wiring member fixed to the support member, and configured to transmit an electrical signal necessary to eject a liquid to the plurality of printing element boards, and a plurality of conductive members arranged in an arranging direction of the plurality of printing element boards, and configured to electrically connect the plurality of printing element boards to the electric wiring member; and heating and curing the sealing member, wherein the sealing member is applied to be divided at at least one place in the arranging direction.

16. The method for manufacturing a liquid ejection head according to claim 15, further comprising before applying the sealing member, providing the intermediate member that extends from the position between the two mutually-facing end sides of the adjoining printing element boards to the position exceeding a connecting point of the electric wiring member with the conductive member, wherein the sealing member is applied to be divided in the arranging direction by the intermediate member, a product of a difference between a coefficient of linear expansion of the intermediate member and a coefficient of linear expansion of the support member and the Young's modulus of the intermediate member is smaller than a product of a difference between a coefficient of linear expansion of the sealing member and a coefficient of linear expansion of the support member and the Young's modulus of the sealing member.

17. The method for manufacturing a liquid ejection head according to claim 16, comprising:

before applying the sealing member, adhering the intermediate member to the end side of one of the printing element boards; and disposing the other of the printing element boards so as to adjoin the one of the printing element boards via the end side.

18. A method for manufacturing a liquid ejection head, comprising:

preparing a plurality of first and second units, each including a first support member, a printing element board provided on the support member and including an ejection port through which a liquid is ejected, and an electric wiring member electrically connected to the printing element board via a conductive member;

forming a sealing member by applying a sealing agent to the conductive member in the first and second units; and fixing the first and second units onto a second support member so that the printing element boards are arranged linearly in a first direction in the first and second units, and the sealing member is disposed in the first direction, wherein in a state after the fixing, the sealing member in the first unit and the sealing member in the second unit are disposed with an interval therebetween.

19. The method for manufacturing a liquid ejection head according to claim 18, wherein the printing element board in the first and second units is substantially parallelogram in shape.

20. A liquid ejection head, comprising:

a second support member;

first and second units provided on the second support member and each including a first support member, a printing element board provided on the support member and including an ejection port through which a liquid is ejected, an electric wiring member electrically connected to the printing element board via a conductive member, and a sealing member configured to seal the conductive member, wherein the printing element board of the first unit and the printing element board of the second unit are arranged linearly in a first direction, and the sealing member of the first unit and the sealing member of the second unit are arranged in the first direction with an interval.

* * * * *